US009288563B2

(12) United States Patent
Hilderman et al.

(10) Patent No.: US 9,288,563 B2
(45) **Date of Patent: *Mar. 15, 2016**

(54) MICROPHONE STAND MOUNTING BRACKETS

(71) Applicant: The TC Group A/S, Risskov (DK)

(72) Inventors: David Kenneth Hilderman, Victoria (CA); Calvin K. Ma, Toronto (CA); Damon Langlois, Victoria (CA)

(73) Assignee: The TC Group A/S, Risskov (DK)

( * ) Notice: Subject to any disclaimer, the term of this patent is extended or adjusted under 35 U.S.C. 154(b) by 267 days.

This patent is subject to a terminal disclaimer.

(21) Appl. No.: 14/203,370

(22) Filed: Mar. 10, 2014

(65) Prior Publication Data

US 2014/0193015 A1 Jul. 10, 2014

Related U.S. Application Data

(63) Continuation of application No. 13/967,218, filed on Aug. 14, 2013, now Pat. No. 8,718,311, which is a continuation-in-part of application No. 13/899,822, filed on May 22, 2013, now Pat. No. 9,179,208.

(60) Provisional application No. 61/683,123, filed on Aug. 14, 2012.

(51) Int. Cl.

| | |
|---|---|
| ***H04R 21/02*** | (2006.01) |
| ***H04R 1/02*** | (2006.01) |
| *H04R 1/08* | (2006.01) |

(52) U.S. Cl.

CPC ..... *H04R 1/021* (2013.01); *H04R 1/02* (2013.01); *H04R 1/025* (2013.01); *H04R 1/026* (2013.01); *H04R 1/08* (2013.01)

(58) Field of Classification Search

USPC ..... 381/362, 363, 374, 390

See application file for complete search history.

(56) References Cited

U.S. PATENT DOCUMENTS

| | | | | |
|---|---|---|---|---|
| 2,216,886 | A | 7/1939 | Langelier | |
| 3,108,828 | A | 10/1963 | Kus | |
| 3,752,902 | A | 8/1973 | Wilson | |
| 4,765,580 | A * | 8/1988 | Wright | F16M 11/00 248/127 |
| 6,125,188 | A | 9/2000 | Hennessy | |
| 6,487,298 | B1 | 11/2002 | Hacker | |
| 2002/0066837 | A1 | 6/2002 | Dunbar | |
| 2008/0253601 | A1 | 10/2008 | Hilderman | |
| 2009/0274330 | A1 * | 11/2009 | Johnson | H04R 1/08 381/362 |

OTHER PUBLICATIONS

"SRM150 Compact Active PA System User's Manual", Feb. 2007, LOUD Technologies Inc., Woodinville, Washington.

"VoiceLive Touch Quick Start" manual, Oct. 2010, TC Helicon Vocal Technologies Ltd.

"VoiceSolo XT VSM-200 XT User Manual", Dec. 2010, TC Helicon Vocal Technologies Ltd., Risskov, Denmark.

Oct. 25, 2013, Office action from US Patent and Trademark Office, in U.S. Appl. No. 13/967,218, which shares the same priority as this U.S. application.

(Continued)

*Primary Examiner* — Amir Etesam

(74) *Attorney, Agent, or Firm* — Kolisch Hartwell, P.C.

(57) ABSTRACT

A mounting bracket system for mounting a loudspeaker monitor onto a microphone stand pole without requiring disassembly of either the loudspeaker monitor or the microphone stand. First and second mounting brackets may be mounted to a loudspeaker monitor or other product to be mounted. An indent on each mounting bracket is configured to engage a microphone stand or another elongated, pole-like structure, supporting the weight of the loudspeaker monitor through frictional forces.

20 Claims, 10 Drawing Sheets

(56) References Cited

OTHER PUBLICATIONS

Jan. 16, 2014, International Search Report of the International Searching Authority from The U.S. Receiving Office, in PCT/US2013/054994, which shares the same priority as this U.S. application.

Jan. 16, 2014, Written Opinion of the International Searching Authority from The U.S. Receiving Office, in PCT/US2013/054994, which shares the same priority as this U.S. application.

Jan. 16, 2015, International Preliminary Report on Patentability, from The International Bureau of WIPO, in PCT/US2013/054994, which shares the same priority as this U.S. application.

* cited by examiner

MICROPHONE STAND MOUNTING BRACKETS

CROSS-REFERENCE TO RELATED APPLICATIONS

This application is a continuation of U.S. patent application Ser. No. 13/967,218, filed Aug. 14, 2013, which is a continuation-in-part of U.S. patent application Ser. No. 13/899,822, filed May 22, 2013, which claims priority to U.S. Provisional Patent Application Ser. No. 61/683,123, filed Aug. 14, 2012, which are hereby incorporated by reference into the present disclosure.

BACKGROUND

Loudspeaker monitors are speakers aimed at a musical performer so the performer can monitor his or her own singing or instrumental contribution during musical performances. Existing loudspeaker monitors are typically designed to be placed in front of the performer on the floor and aimed upwards so that the performer may adequately highlight his or her sound in relation to the surrounding music. As each performer in a group often will have a monitor, loudspeaker monitors are ubiquitous in musical performance environments. However, floor monitors may be difficult to hear because they are disposed relatively far from the singer. In addition, parameters such as volume and the like cannot easily be adjusted because a floor monitor is typically out of reach of the performer.

Microphone stands are pole-like structures designed to hold a microphone for a musical performer. Like monitors, they are also found in great numbers in musical performance environments. A singer or performer stands close to a microphone pole in order to approach the microphone that will project the performer's sound. It therefore would be desirous to attach the loudspeaker monitor to the microphone stand so that the performer could be closer to the loudspeaker to improve hearing and accessibility of controls.

Loudspeaker monitors have been made in the past that can mount onto standard microphone stands, allowing the user to be closer to the speakers. Examples include the TC-Helicon VSM series and the Mackie SRM 150 series loudspeaker monitors. However, to install these monitors onto a microphone stand generally requires the disassembly and reassembly of the microphone stand and the boom. Furthermore, loudspeaker monitors may require special adaptors that allow each part of the microphone stand to attach directly to the monitor. The disadvantages of such a system include the amount of time required to attach the loudspeaker, the cost of multiple adapters, and the fact that these adaptors can be easily lost or misplaced when they need to be removed or exchanged for another.

For the above reasons, it is desirable to develop a mounting bracket system that allows a performer to attach a loudspeaker monitor or other object to a microphone stand pole without requiring any tools or disassembly of the microphone stand.

DETAILED DESCRIPTION

The present teachings disclose a mounting bracket system, including apparatus and methods, for mounting a loudspeaker monitor onto a microphone stand without requiring disassembly of either the loudspeaker monitor or the microphone stand. The disclosed mounting bracket system comprises a set of mounting brackets attached or attachable to a loudspeaker. Each mounting bracket may include an indent adapted to fit on the loudspeaker and secure it to a microphone stand. The disclosed mounting bracket system reduces the amount of steps and time needed to set up a microphone stand-mounted loudspeaker monitor. In addition, the present teachings can be applied to mount other objects onto a microphone stand or another elongated, pole-like structure, without the use of generic fastener-style mounting attachments.

Figure 1:
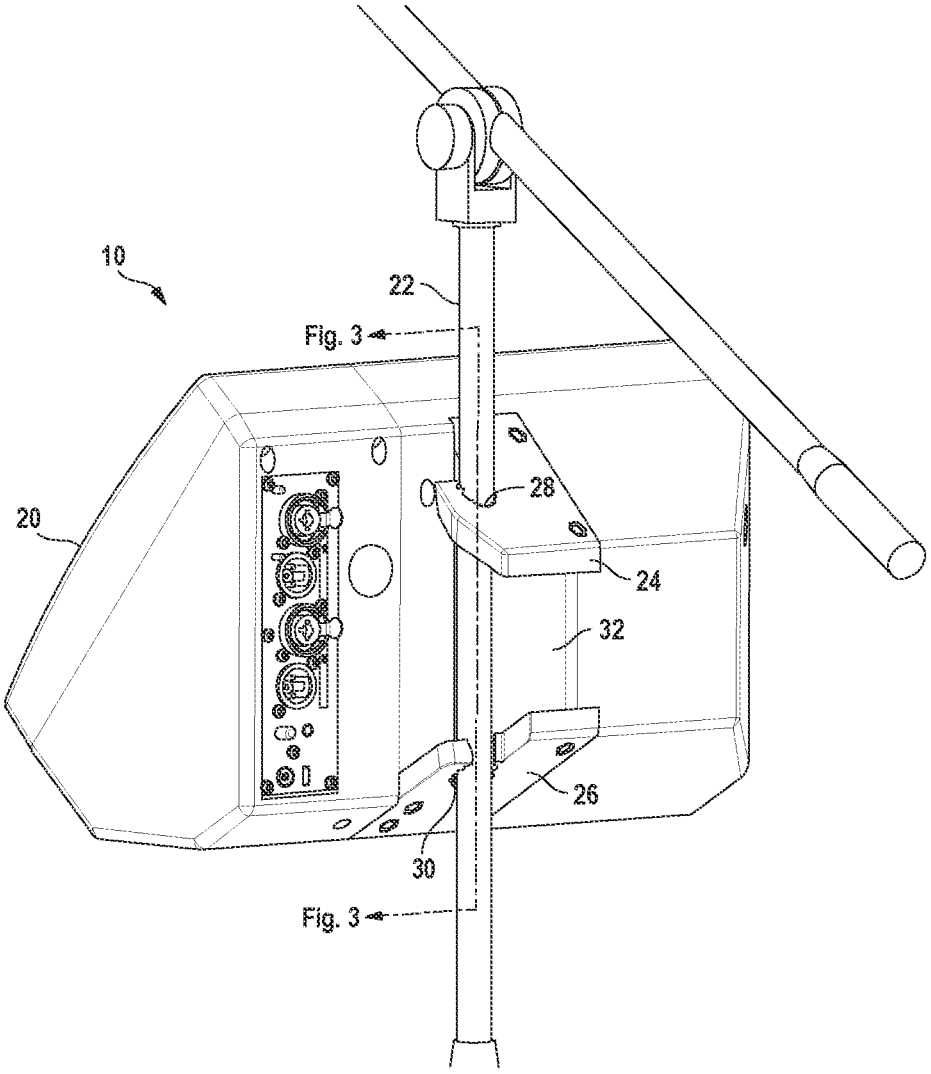
FIG. 1 is a perspective view of a loudspeaker monitor mounted on a microphone stand with mounting brackets, according to aspects of the present disclosure.

FIG. 1 is a perspective view depicting a first example of a loudspeaker monitor mounting bracket system according to the present teachings. The loudspeaker monitor mounting bracket system, generally indicated as 10, also may be referred to herein as a pole-mountable loudspeaker monitor system, or simply a mounting bracket system. In system 10, a loudspeaker monitor 20 is secured to a microphone stand pole 22 by way of a first mounting bracket 24 and a second mounting bracket 26. A first indent 28 is formed in the first mounting bracket 24 and faces generally toward the back surface or back side 32 of the loudspeaker monitor 20 when the first mounting bracket is attached to the monitor. A second indent 30 is formed in the second mounting bracket 26 and faces generally away from the back side 32 of the loudspeaker monitor 20 when the second mounting bracket is attached to the monitor.

As depicted in FIG. 1, first indent 28 and second indent 30 are substantially U-shaped. Furthermore one of the indents or both is serrated, i.e. one or both indent includes a surface with tooth-like notches adapted to grip the microphone stand pole 20 when the pole is placed within the indent. However, one or both of the indents may include an alternate structure for increased gripping. One such structure may be a narrowing protrusion at the open end of the indent to restrict the movement of the microphone stand pole 22. To provide further gripping ability, one or both of the indents may be coated with a high-friction material, one example of which may be rubber. The indents may also take any other form allowing each to face generally in the specified direction and, in particular, may be shaped to increase an area of contact between the indent and the microphone stand pole. In general, indents 28 and 30 are provided with a design (i.e., constructed from a material and with an inner surface area and geometry) sufficient to support a loudspeaker monitor on a microphone stand pole through frictional forces between the indents and the pole.

Figure 2:
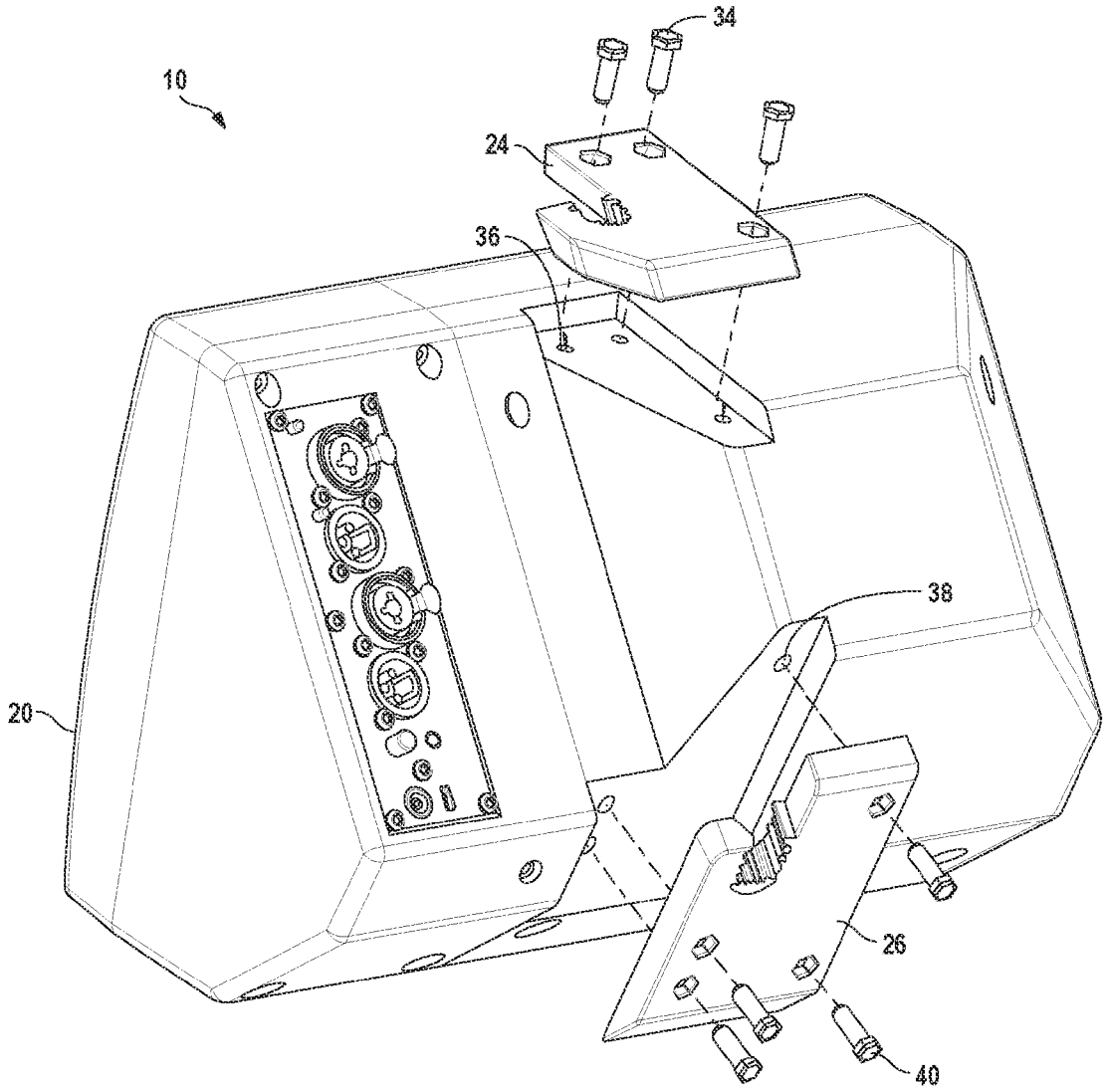
FIG. 2 is an exploded isometric view of the microphone stand mounting bracket system of FIG. 1.

FIG. 2 is an exploded isometric view depicting how microphone stand mounting system 10 may be assembled according to aspects of the present teachings. In the depicted embodiment, the first mounting bracket 24 is attached to the loudspeaker monitor 20 using a first set of screw or bolt-style fasteners comprising at least one fastener 34. Each fastener 34 connects to an attachment point 36 that is part of a first set of attachment points on the body of the loudspeaker monitor 20. Similarly, the second mounting bracket 26 is fastened to the loudspeaker monitor 20 using a second set of screw or bolt-style fasteners comprising at least one fastener 40. Each fastener 40 connects to an attachment point 38, part of a second set of attachment points on the body of the loudspeaker monitor 20.

In the depicted example, the locations of the attachment points on the body of the loudspeaker monitor 20 are configured such that the first and second mounting brackets 24 and 26 are angled toward each other as they extend away from the back surface 32 of the loudspeaker monitor 20. However, the attachment points and corresponding brackets may be configured to extend outward at any desired angle and location to achieve the desired grip on a microphone stand pole (or other similar object) through frictional forces.

As is also depicted in FIGS. 1-2, the first mounting bracket 24 is configured to be attached to a top portion of the loudspeaker monitor 20, and the second mounting bracket 26 is configured to be attached to a bottom portion of the loudspeaker monitor 20. Thus, the first mounting bracket 24 attaches above the second mounting bracket 26. However, the mounting brackets may be configured to attach to the monitor in any configuration such that they extend away from the back surface 32 to the desired location of engagement with the microphone stand pole.

Figure 3:
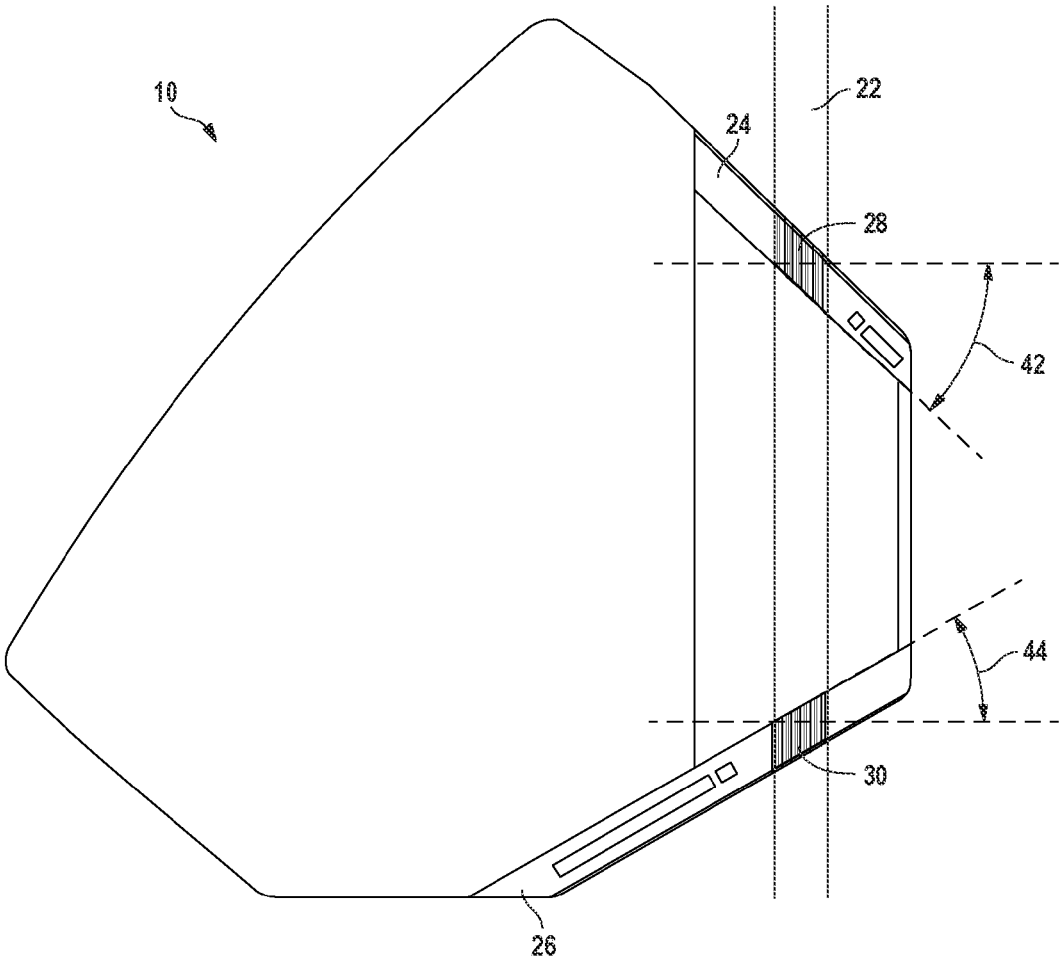
FIG. 3 is a schematic side sectional view of a loudspeaker monitor mounted on a microphone.

FIG. 3 depicts a schematic side sectional view of mounting bracket system 10, where the view is sectioned at microphone stand pole 22, but without showing any of the irrelevant internal structure of the loudspeaker monitor. The upper angle 42 at which the first mounting bracket 24 is oriented relative to an axis perpendicular to the microphone stand, and the lower angle 44 at which the second mounting bracket 26 is oriented relative to an axis perpendicular to the microphone stand, can be adjusted to accommodate different housing sizes and geometries of the object to be mounted. However, the angle of the tooth-like notches of the first indent 28 and second indent 30, when serrated as depicted, may be configured to remain parallel to the microphone stand pole 22 to retain maximum surface area contact with the pole and thus provide the best gripping force.

Loudspeaker monitor 20 stays in place through frictional forces provided by the indents, which in turn depend upon the coefficient of friction between the indents and the microphone stand pole, and the normal forces exerted against the pole by the two mounting brackets. First mounting bracket 24 exerts a normal force upon microphone stand pole 22 toward loudspeaker monitor 20, and second mounting bracket 26 exerts a normal force upon microphone stand pole 22 away from loudspeaker monitor 20, so that the normal forces balance each other. Additionally, when the loudspeaker monitor is in static equilibrium, the frictional forces provided by the indents collectively balance the weight of loudspeaker monitor 20 such that it stays in place.

Figure 4:
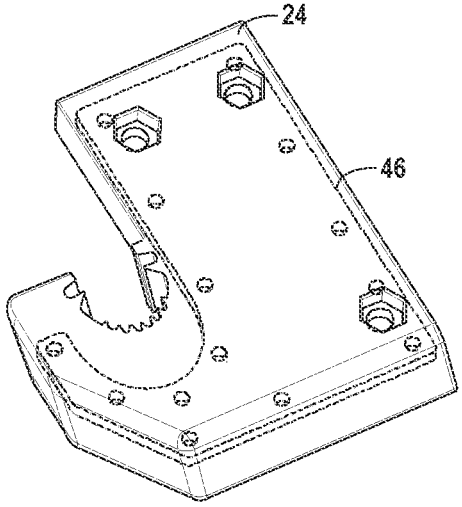
FIG. 4 is an isometric view of an exemplary first mounting bracket according to aspects of the present disclosure.
Figure 5:
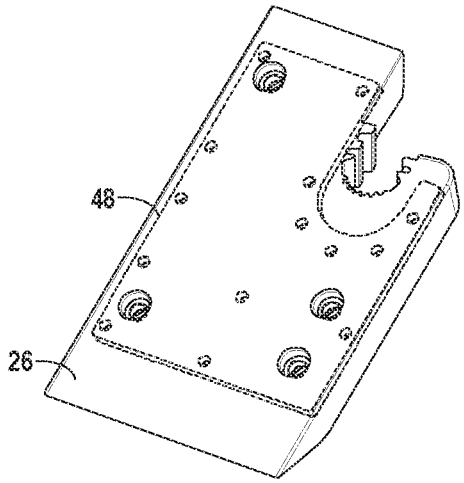
FIG. 5 is an isometric view of an exemplary second mounting bracket according to aspects of the present disclosure.

As depicted in FIG. 4, first mounting bracket 24 may include a first base plate 46 (shown in dashed lines) contained within the bracket. Similarly, second mounting bracket 26 may include a second base plate 48 contained within the bracket, as depicted in FIG. 5. Each base plate may be designed and constructed to strengthen the corresponding bracket and provide the rigidity necessary to support the object being mounted. The base plate may be made of any material suitable for forming a bracket with the desired physical attributes, and in some cases may be constructed of a metal, injection molded plastic, or other similarly rigid material. The corresponding mounting bracket may be constructed by attaching an over-moulding to the base plate, as depicted in FIGS. 4 and 5, and such over-moulding may use a high-friction material, such as rubber, for gripping the pole.

Figure 6:
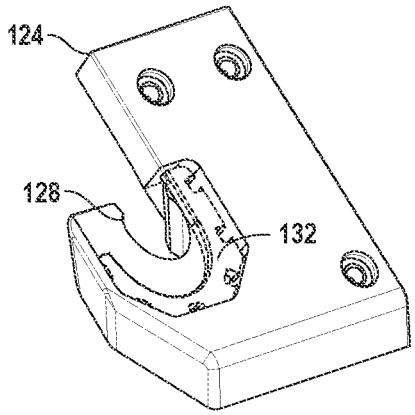
FIG. 6 is an isometric view of another exemplary first mounting bracket according to aspects of the present disclosure.
Figure 7:
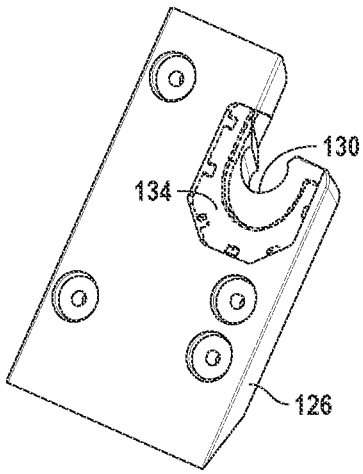
FIG. 7 is an isometric view of another exemplary second mounting bracket according to aspects of the present disclosure.

FIGS. 6 and 7 depict another illustrative example of mounting brackets that may be used in loudspeaker monitor mounting bracket systems such as system 10, according to aspects of the present teachings. Referring to FIG. 6, a first mounting bracket 124 includes a first indent 128. Rather than including a base plate, a first indent frame 132 is formed as part of the first mounting bracket 124, and the indent frame is covered by a high-friction material, such as rubber, to form indent 128. Similarly, FIG. 7 shows a second mounting bracket 126, which includes a second indent 130. A second indent frame 134 is formed as part of the second mounting bracket 126 and is covered by a high friction material to form indent 130.

The mounting brackets and indent frames of the example depicted in FIGS. 6-7 may be a single part that may be molded from a material such as plastic. For example, brackets 124 and 126 may be constructed by injection molding of a thermoplastic material. In addition, the first and second indent frames 132 and 134 may be integrally formed as a part of each single part bracket. The indent frames then may be coated with a high-friction material, one example of which may be rubber, to form indents 128, 130 with strong gripping ability.

As depicted in FIGS. 6-7, the indents also may include a gripping structure formed by a narrowing protrusion at the open end of the indent, to restrict the movement of the microphone stand pole within the indent. In the embodiment of FIGS. 6-7, these narrowing protrusions are formed in the rubber portions of the brackets that are attached to the indent frames to form the indents. In other cases, the indents may include an alternate structure for increased gripping, such as serrated indents, or in some cases may be entirely u-shaped with no specific additional gripping structure. In any case, the indents should provide sufficient friction to engage a microphone stand pole securely, due to factors such as the coefficient of friction and surface area of each indent, in combination with the angles of contact of the indents with the pole.

Figure 8:
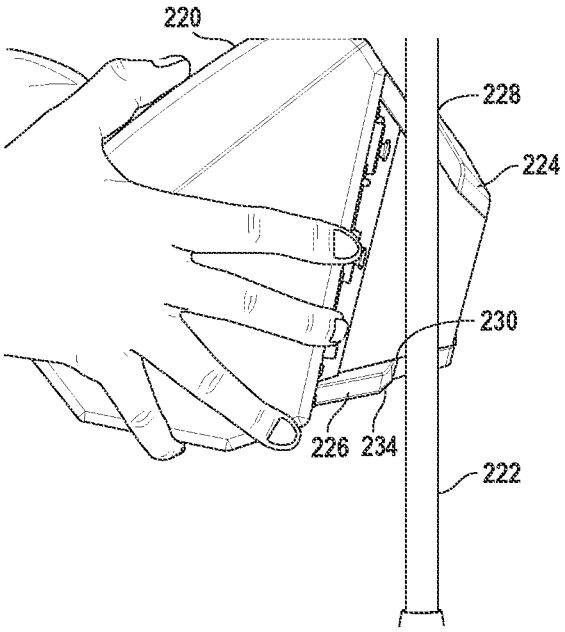
FIGS. 8 and 9 are side elevational views depicting installation of a loud speaker monitor onto a microphone stand pole.
Figure 9:
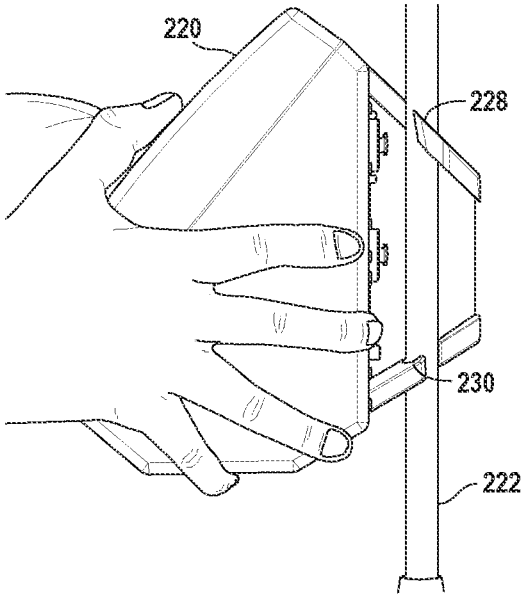

FIGS. 8 and 9 depict steps that may be performed to install a pole-mountable loudspeaker monitor system, according to aspects of the present teachings. To install a loudspeaker monitor 220 onto a microphone stand pole 222 using an exemplary mounting bracket system such as those described above, a user positions loudspeaker monitor 220 with microphone stand pole 222 aligned with the gap between first mounting bracket 224 and back side 232 of loudspeaker monitor 220, and rotates monitor 220 so that microphone stand pole 222 is distal to an inner edge 234 of second mounting bracket 226. The user then moves the loudspeaker monitor laterally until pole 222 is laterally aligned with indents 228 and 230. As depicted in FIG. 9, the user then rotates the loudspeaker so that the first indent 228 and second indent 230 each slide into engagement with the microphone stand pole 222.

Figure 10:
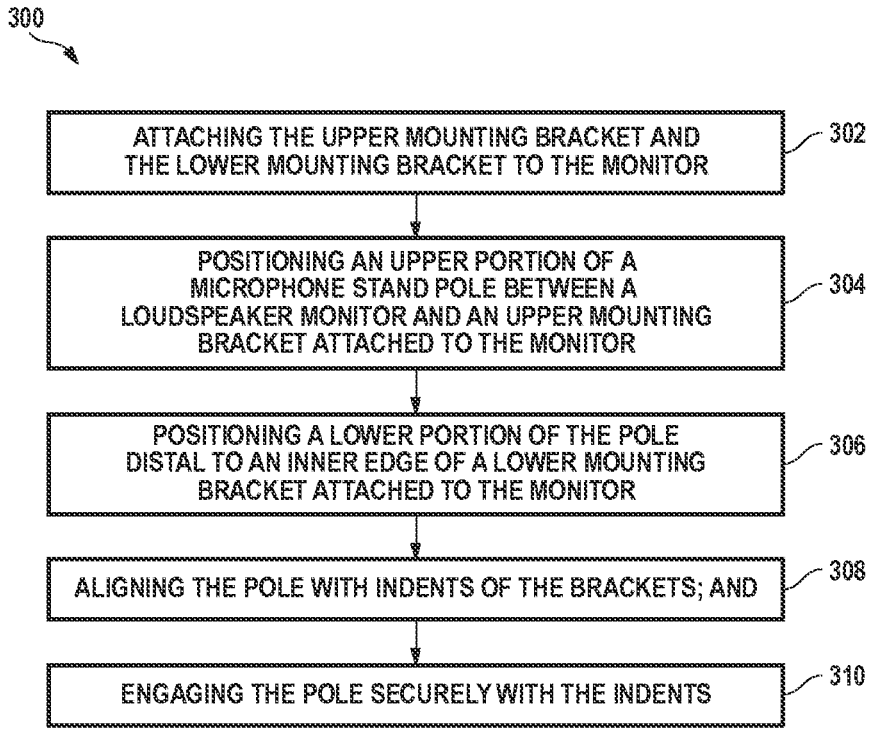
FIG. 10 is a flowchart depicting a method of installing a loudspeaker monitor onto a microphone stand pole using mounting brackets, according to aspects of the present teachings.

FIG. 10 depicts a method, generally indicated at 300, of mounting a loudspeaker monitor to a microphone stand, according to aspects of the present teachings. Method 300 may be generally suitable for use with various mounting bracket systems described according to the present teachings, including the systems shown and described above.

At step 302, an upper mounting bracket is attached to a corresponding location on the monitor and a lower mounting bracket is similarly attached to its corresponding location on the monitor. At step 304, an upper portion of a microphone stand pole is positioned between the loudspeaker monitor and the upper mounting bracket attached to the monitor. At step 306, a lower portion of the pole is positioned distal to an inner edge of the lower mounting bracket attached to the monitor. At step 308, the pole is aligned with indents of the first and second mounting brackets. And at step 310, the pole is securely engaged with each indent.

According to the present teachings, all of the steps of method 300 may be performed without any disassembly of the microphone stand. Furthermore, the mounting brackets used in conjunction with method 300 may include any of the properties previously described with respect to the exemplary embodiments, such as indents that are substantially u-shaped, coated with rubber or some other relatively high-friction material, and/or serrated, among others.

Figure 11:
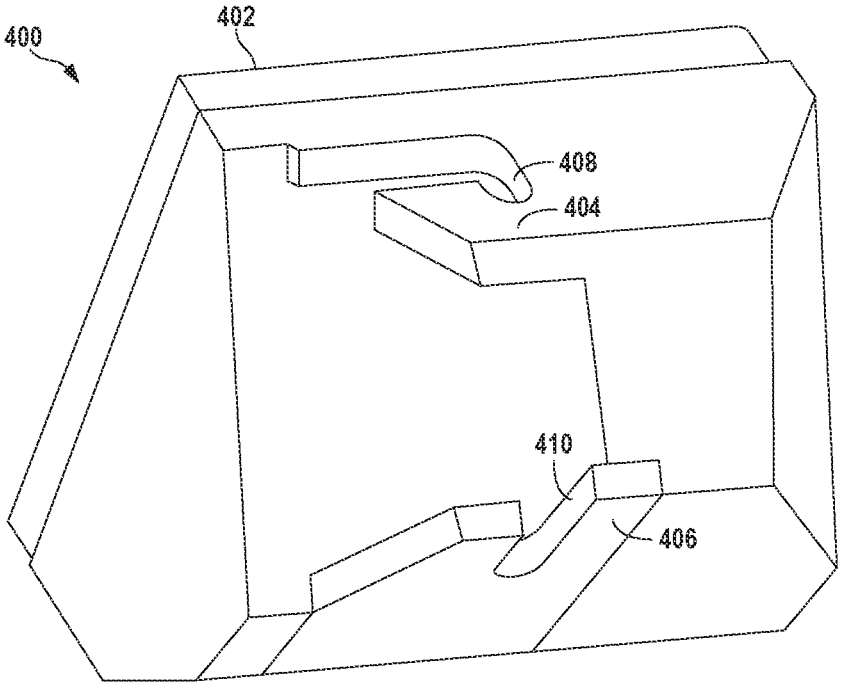
FIG. 11 is an isometric view of still another exemplary mounting bracket according to aspects of the present disclosure.

FIG. 11 depicts still another mounting bracket system, generally indicated at 400, according to aspects of the present teachings. Mounting bracket system 400 is generally similar in many respects to the mounting bracket systems depicted in FIGS. 1-9, except that one of the mounting brackets of system 400 is integrally formed with the loudspeaker to be mounted. In other words, one of the mounting brackets is formed as a portion of the loudspeaker housing or exterior case, rather than formed separately and then attached to the loudspeaker with mounting hardware.

More specifically, mounting bracket system 400 includes a loudspeaker monitor 402, an integrally formed upper mounting bracket 404, and a detachable lower mounting bracket 406. Upper mounting bracket 404 may be integrally formed with the loudspeaker monitor, for example, by injection molding the exterior case of the loudspeaker monitor to include upper mounting bracket 404. Lower mounting bracket 406 may be formed separately by any suitable method, such as injection molding, and may be attached to the loudspeaker monitor with any suitable mounting hardware, such as bolts or screws. In some cases, one or both mounting brackets may include a relatively stiff insert, such as a base plate or internal frame, over which a different material such as a suitable high friction material is molded, as described previously with respect to FIGS. 4-7.

Upper mounting bracket 404 includes an indent 408, and lower mounting bracket 406 includes an indent 410, each of which is configured to receive and securely engage a microphone stand pole (not shown), through frictional forces. In some cases, as described with respect to previous embodiments, indents 408 and 410 may include serrations or other structures configured to increase the frictional forces that can be exerted against the microphone stand pole by the indents and vice versa.

Figure 12:
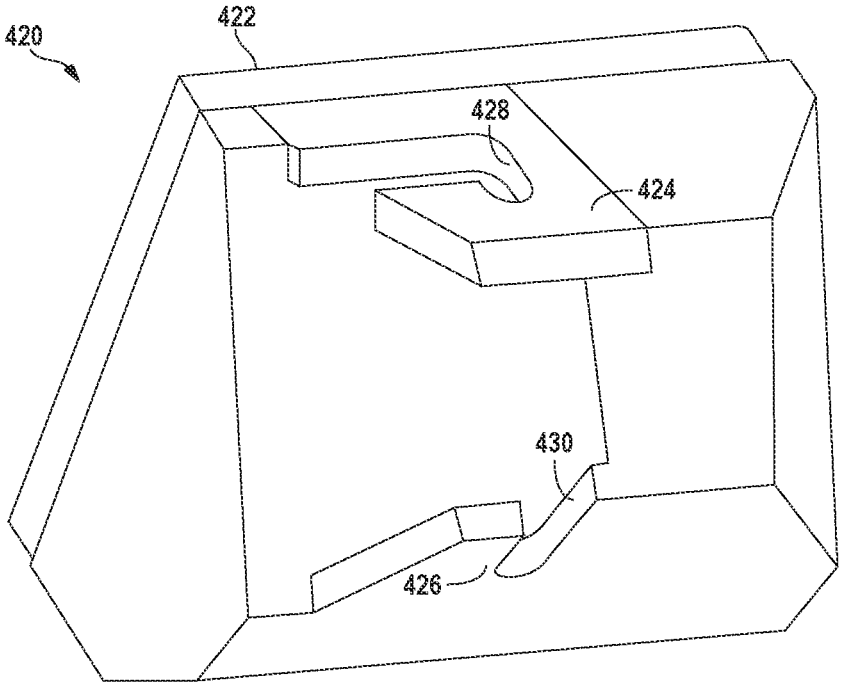
FIG. 12 is an isometric view of yet another exemplary mounting bracket according to aspects of the present disclosure.

FIG. 12 depicts still another loudspeaker monitor mounting system, generally indicated at 420, according to aspects of the present teachings. Mounting system 420 is similar to system 400, except that in system 420, the lower mounting bracket rather than the upper mounting bracket is integrally formed with the loudspeaker monitor or speaker case. Specifically, system 420 includes a loudspeaker monitor 422, a detachable upper mounting bracket 424 having an indent 428, and an integrally formed lower mounting bracket 426 having an indent 430. Aside from the fact that the upper mounting bracket is detachable and the lower mounting bracket is an integral part of the loudspeaker exterior, the components of system 420 are equivalent to their counterparts in system 400 and will not be described in further detail.

Figure 13:
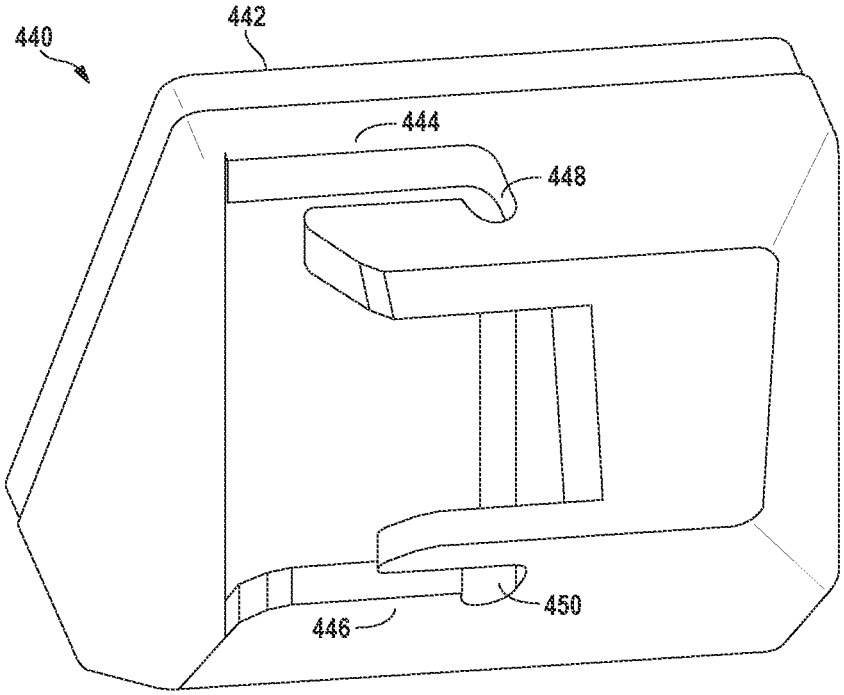
FIG. 13 is an isometric view of yet another exemplary mounting bracket according to aspects of the present disclosure.

FIG. 13 depicts yet another loudspeaker monitor mounting bracket system, generally indicated at 440, according to aspects of the present teachings. Mounting system 440 is similar to systems 400 and 420 except that in system 440, both the upper mounting bracket and the lower mounting bracket are integrally formed with the loudspeaker monitor or speaker case. Specifically, system 440 includes a loudspeaker monitor 442, an integrally formed upper mounting bracket 444 having an indent 448, and an integrally formed lower mounting bracket 446 having an indent 450. Aside from the fact that both mounting brackets are integral parts of the loudspeaker exterior, the components of system 440 are equivalent to their counterparts in systems 400 and 420 and will not be described in further detail.

Figure 14:
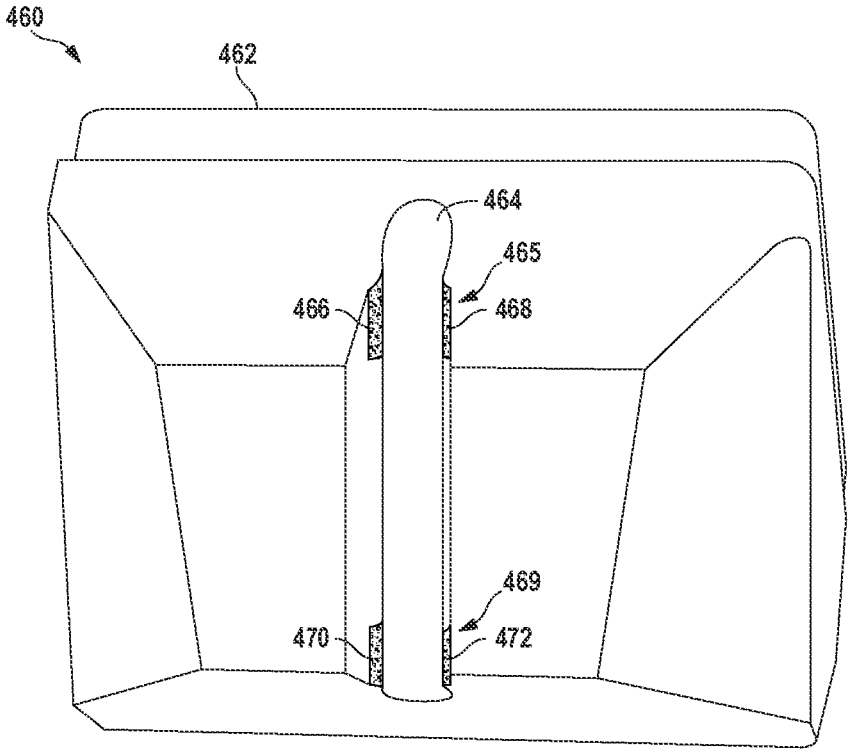
FIG. 14 is an isometric view of yet another exemplary mounting bracket according to aspects of the present disclosure.

FIG. 14 depicts yet another loudspeaker monitor mounting system, generally indicated at 460, according to aspects of the present teachings. Mounting system 460 can be described as an integral or integrated system, because the portions of the system configured to grip a microphone stand pole are integral parts of the loudspeaker, rather than detachable parts. However, the structure of mounting system 460 is otherwise somewhat different than the previously described mounting systems.

Specifically, mounting system 460 includes a loudspeaker monitor 462 that has a groove 464 formed in its exterior. Groove 464 may be roughly hemispherical in cross section, with an internal diameter approximately the same as the diameter a microphone stand pole to which the speaker is to be mounted. For example, groove 464 may have an internal diameter of approximately ¼ inches, ⅜ inches, or ⅝ inches, among others. Groove 464 includes an upper mounting area generally indicated at 465, and a lower mounting area generally indicated at 469.

Upper mounting area 465 includes a pair of opposing mounting surfaces 466, 468, which are slightly flexible to allow insertion of a microphone stand pole into groove 464, but which are biased inwardly and are thus configured to exert radial (i.e., normal) forces against the pole when it is disposed in the groove. Similarly, lower mounting area 469 includes another pair of opposing mounting surfaces 470, 472 having the same characteristics. This results in frictional forces against a pole disposed within groove 464, each of which has a maximum value which is proportional to both the size of the normal force exerted against the pole by the associated mounting surface, and the coefficient of static friction between the mounting surface and the pole.

The frictional forces between the mounting surfaces and a microphone pole can be described by an elementary formula of basic mechanics, $f_s \leq \mu_s F_N$, where $f_s$ is the frictional force, $\mu_s$ is the coefficient of static friction, and $F_N$ is the magnitude of the normal force between the two surfaces. Accordingly, some or all of mounting surfaces 466, 468, 470 and 472 may be coated with a relatively high friction material, such as rubber, to increase the coefficient of friction and thus to increase the potential frictional forces that can support loudspeaker monitor 462 on a microphone pole.

Figure 15:
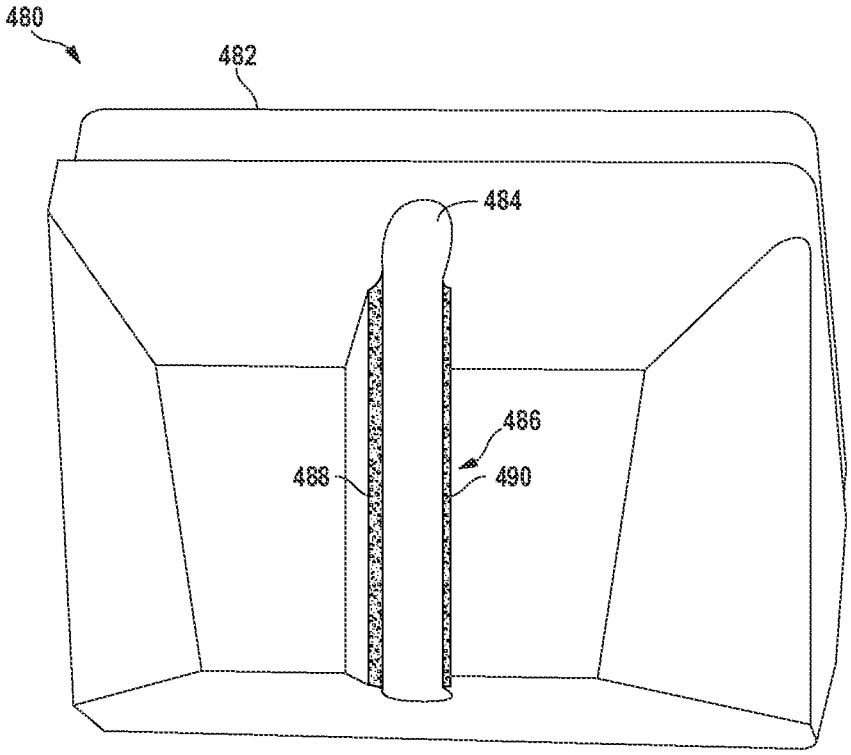
FIG. 15 is an isometric view of yet another exemplary mounting bracket according to aspects of the present disclosure.

FIG. 15 depicts yet another loudspeaker monitor mounting system, generally indicated at 480, according to aspects of the present teachings. Mounting system 480 is somewhat similar to mounting system 460 depicted in FIG. 14. Specifically, mounting system 480 includes a loudspeaker monitor 482 having a groove 484 integrally formed in the exterior of the loudspeaker. Groove 484 is generally similar to groove 464 of system 460, and will not be described further. A mounting area, generally indicated at 486, includes a pair of opposing mounting surfaces 488, 490, which are configured to support the loudspeaker monitor on a microphone stand pole disposed in groove 484, by exerting frictional forces on the pole and thus receiving frictional forces from the pole.

Mounting surfaces 488, 490 are flexible with an inward bias, and may be coated with a relatively high friction material, for the same reasons described above with respect to the mounting surfaces of mounting system 460. However, in mounting system 480, a single pair of opposing mounting surfaces extends along substantially the entire length of groove 484. This is distinct from system 460, in which discrete upper and lower pairs of opposing mounting surfaces are disposed at corresponding positions along groove 464. In some cases, the increased surface area provided by mounting surfaces 488, 490 may be advantageous, by providing a greater maximum frictional force.

Figure 16:
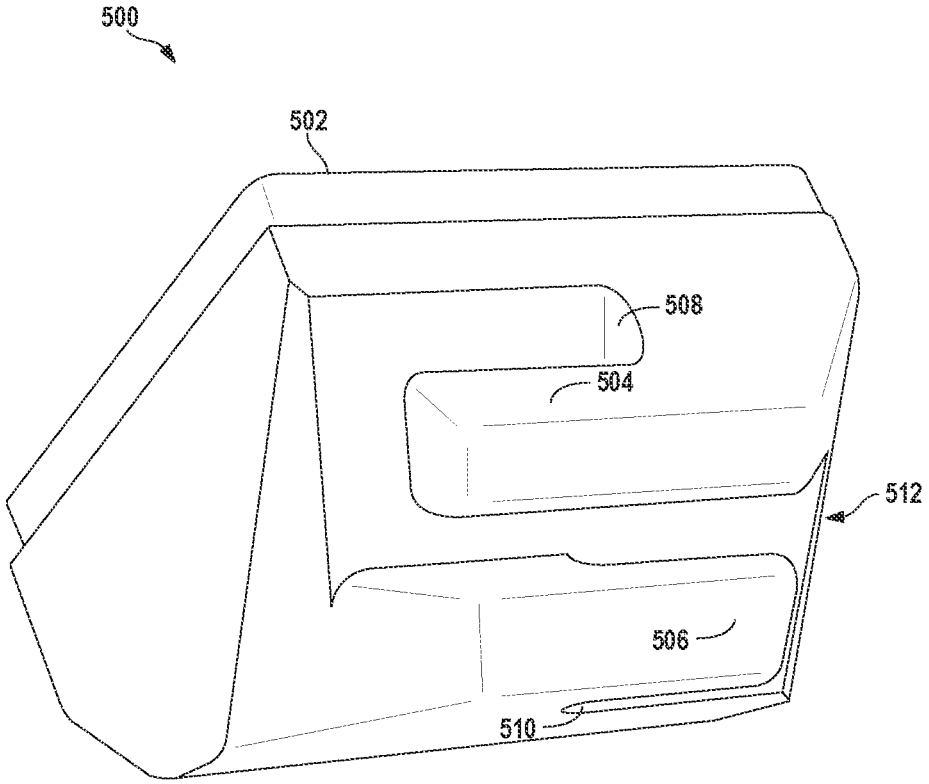
FIG. 16 is an isometric view of yet another exemplary mounting bracket according to aspects of the present disclosure.

FIG. 16 depicts still another loudspeaker monitor mounting system, generally indicated at 500, according to aspects of the present teachings. Mounting system 500 includes a loudspeaker monitor 502, an integrally formed upper mounting bracket 504, and an integrally formed lower mounting bracket 506. As in previous embodiments, "integrally formed" means that the mounting bracket is formed as a portion of the exterior of the loudspeaker, rather than being formed separately and then attached to the loudspeaker with mounting hardware.

Upper mounting bracket 504 includes an upper indent 508, and lower mounting bracket includes a complementary lower indent 510. Rather than facing generally toward and away from the loudspeaker (compare with indents 28 and 30 in FIG. 1), indents 508 and 510 are oriented generally parallel to the back surface of the loudspeaker. However, each indent generally has a size to securely receive a vertically oriented microphone stand pole. Furthermore, a space between the two mounting brackets forms a microphone stand insertion groove 512, to allow loudspeaker monitor 502 to be mounted to a microphone stand pole.

More specifically, loudspeaker monitor 502 may be positioned with a microphone stand pole disposed within insertion groove 512, and then rotated 90 degrees until the pole is positioned within indents 508, 510, which can then support the loudspeaker monitor on the pole with frictional forces. As described with respect to previous embodiments, indents 508, 510 may include various features configured to increase the possible frictional forces they can exert against a pole. These features can include, among others, serrations, high friction coatings, and/or flexible, radially biased protrusions such as the mounting surfaces depicted in FIGS. 14-15.

There are ways in which a microphone stand mounting bracket system according to the present teachings can be used in other applications. Instead of a loudspeaker monitor, it is also possible to install the brackets onto different products that can benefit from being mounted onto a microphone stand. For example, it may be desirable to attach laptop trays, musical mixers, utility trays, etc. to a microphone stand pole. The present teachings are not limited to mounting loudspeaker monitors.

Similarly, the present teachings are not limited to mounting objects onto microphone stand poles. A bracket system according to the present teachings can be implemented to mount arbitrary objects onto any pole-like structure with an arbitrary diameter, by changing parameters such as the sizes and angles of the mounting brackets, the size of the indent teeth on the mounting brackets, and/or the materials used to construct the mounting brackets. For example, it may be desirable to mount spotlights, fans, computer screens, etc. onto poles on a stage or otherwise at a performance venue. The present teachings generally contemplate mounting any objects associated with musical performances onto stands or poles of arbitrary diameter, in a convenient and tool-free manner.

What is claimed is:

1. A loudspeaker monitor mounting bracket system, comprising:

a loudspeaker monitor; a first mounting bracket extending from a rear portion of the loudspeaker monitor; a first indent formed in the first mounting bracket and configured to engage a microphone stand; a second mounting bracket extending from the rear portion of the loudspeaker monitor; and a second indent formed in the second mounting bracket and configured to engage the microphone stand; wherein the first mounting bracket is disposed above the second mounting bracket, the first indent is configured to face generally toward the rear portion of the loudspeaker monitor, and the second indent is configured to face generally away from 15 the rear portion of the loudspeaker monitor; wherein the indents are configured to exert frictional forces against the microphone stand sufficient to balance the weight of the loudspeaker monitor.

2. The system of claim 1, wherein the first mounting bracket is formed separately from the loudspeaker monitor and the second mounting bracket is integrally formed as a portion of an exterior case of the loudspeaker monitor.

3. The system of claim 1, wherein the first and second mounting brackets are both integrally formed as portions of an exterior case of the loudspeaker monitor.

4. The system of claim 1, wherein the indents are coated with a high friction material.

5. The system of claim 1, wherein each indent is substantially u-shaped.

6. The system of claim 1, wherein at least one of the indents is serrated.

7. The system of claim 1, wherein the mounting brackets are angled toward each other as they extend away from the rear portion of the monitor.

8. The system of claim 1, wherein the indents are oriented generally toward and away from the back side of the monitor.

9. The system of claim 1, wherein the indents are oriented generally parallel to the back side of the monitor.

10. The system of claim 9, wherein a space between the first and second mounting brackets defines a microphone stand insertion groove.

11. A loudspeaker monitor mounting bracket system, comprising:

a loudspeaker monitor;

a first mounting bracket extending from an exterior of the loudspeaker monitor;

a second mounting bracket disposed below the first mounting bracket and extending from the exterior of the loudspeaker monitor;

a first indent formed in the first mounting bracket and configured to exert a normal force upon a microphone stand pole toward the loudspeaker monitor; and a second indent formed in the second mounting bracket and configured to exert a normal force upon the microphone stand pole away from the loudspeaker monitor;

wherein the indents are configured to exert frictional forces against the microphone stand pole sufficient to balance the weight of the loudspeaker monitor.

12. The system of claim 11, wherein the indents are configured to receive the microphone stand pole without any disassembly of a corresponding microphone stand.

13. The system of claim 11, wherein a space between the first and second mounting brackets forms an insertion groove for inserting the microphone stand pole.

14. The system of claim 13, wherein the loudspeaker monitor is configured to be positionable with the microphone stand pole disposed within the insertion groove, and then rotated until the microphone stand pole is positioned within the indents.

15. The system of claim 11, wherein at least one of the indents is coated with a high friction material.

16. The system of claim 11, wherein the indents are substantially u-shaped.

17. A loudspeaker monitor mounting bracket system, comprising:

a first mounting bracket attachable to an exterior of a loudspeaker monitor;

a second mounting bracket attachable to the exterior of the loudspeaker monitor;

a first indent formed in the first mounting bracket and configured to exert a normal force upon a microphone stand pole directed toward the loudspeaker monitor when the first mounting bracket is attached to the loudspeaker monitor; and a second indent formed in the second mounting bracket and configured to exert a normal force upon the microphone stand pole directed away from the loudspeaker monitor when the second mounting bracket is attached to the loudspeaker monitor;

wherein the indents are configured to engage the microphone stand pole with frictional forces collectively sufficient to support the weight of the loudspeaker monitor.

18. The system of claim 17, wherein the indents are substantially u-shaped.

19. The system of claim 18, wherein the indents are serrated.

20. The system of claim 17, wherein the indents are coated with a high-friction material.

* * * * *

UNITED STATES PATENT AND TRADEMARK OFFICE

CERTIFICATE OF CORRECTION

PATENT NO. : 9,288,563 B2
APPLICATION NO. : 14/203370
DATED : March 15, 2016
INVENTOR(S) : David Kenneth Hilderman et al.

It is certified that error appears in the above-identified patent and that said Letters Patent is hereby corrected as shown below:

Column 8, line 37, in Claim 1 after "the first indent is configured to face generally toward the rear portion of the loudspeaker monitor, and the second indent is configured to face generally away from":, delete "15"

Signed and Sealed this
Fourteenth Day of June, 2016

Michelle K. Lee

Michelle K. Lee
*Director of the United States Patent and Trademark Office*